United States Patent [19]

Miyakoshi

[11] 4,275,400

[45] Jun. 23, 1981

[54] ANTENNA COIL AND ITS SUPPORT STRUCTURE MOUNTING

[76] Inventor: Masashi Miyakoshi, 1386 Nagata-cho, Minami-ku, Yokohama, Japan

[21] Appl. No.: 931,677

[22] Filed: Aug. 7, 1978

[30] Foreign Application Priority Data

Aug. 8, 1977 [JP] Japan ..... 52-106020[U]
Aug. 8, 1977 [JP] Japan ..... 52-106021[U]
Apr. 28, 1978 [JP] Japan ..... 53-58125[U]

[51] Int. Cl.[3] ..... H01Q 1/36
[52] U.S. Cl. ..... 343/788; 343/842
[58] Field of Search ..... 343/788, 872, 787, 842

[56] References Cited

U.S. PATENT DOCUMENTS 2,740,114 3/1956 Adams ..... 343/788
3,349,405 10/1967 Wright ..... 343/788
3,364,487 1/1968 Maheux ..... 343/788

*Primary Examiner*—David K. Moore
*Attorney, Agent, or Firm*—Lackenbach, Lilling & Siegel

[57] ABSTRACT

This disclosure is directed to an antenna coil and its support which comprises a terminal board made of heat resisting plastic material. The terminal board is provided with mountings, each of which has an opening extending in the vertical direction. Also provided are antenna supporting members, each having an antenna supporting portion at the upper part thereof and an insert or connector portion at the lower part thereof, the insert being adapted to be inserted in the opening of a respective mounting. Further, in accordance with another aspect of the invention, an antenna coil with a terminal board is disclosed, wherein at least one of the antenna supporting members is provided with a coil bobbin, the coil bobbin being molded integral with the respective antenna supporting member.

9 Claims, 14 Drawing Figures

ANTENNA COIL AND ITS SUPPORT STRUCTURE MOUNTING

BACKGROUND OF THE INVENTION

The present invention relates to an antenna coil and its support means, and more particularly to an antenna coil with a terminal board (a so called ferrite antenna) widely used for radio, tape recorders associated with radio or the like. It substantially comprises antenna supporting members, mountings for fastening to a base board and/or antenna support means.

It has been recognized that the hitherto known antenna coil or antenna support means has a number of drawback which are caused by physical, chemical or thermal conditions or other economical conditions inherrent to the structure of the hitherto known antenna coil.

Prior to considering the description of the antenna coil and its support means in accordance with the present invention, the conventional antenna coil support will be briefly described below in order to facilitate understanding of the present invention.

DESCRIPTION OF THE PRIOR ART

Typical conventional antenna support means are illustrated in FIGS. 1 to 3. The antenna coil support means as shown in FIG. 1 comprizes antenna supporting members 1 and a terminal board 3 which is provided with a plurality of terminals 2, the members and the board being molded integral with each other. However, the antenna supporting members have little shock absorbability, thereby, resulting in the drawback that the ferrite core 4 is easily broken when it falls on the ground. Moreover additional drawbacks with the hitherto known antenna coil are that it has less flexibility to accommodate a variation in the height h from the bottom of the terminal plate 3 to the antenna coil 5 or in the diameter or shape of the ferrite core 4 to be mounted, that assembling is performed with much difficulty, and that molding dies are expensive to manufacture.

The antenna coil support as illustrated in FIG. 2 is characterized in that there are cutouts 7 provided at both ends of the flat terminal board 6, in which the antenna supporting members 8 are fit. The antenna coil as illustrated in FIG. 2, however, has drawbacks in that the terminal board 6 and supporting members 8 are easily broken subject to an external force when it falls on the ground, that it is expensive to manufacture and that dies for molding them are very complicated and expensive to manufacture.

The antenna coil suppot as illustrated in FIG. 3 is characterized in that the antenna coil 11 is mounted on the terminal board 10 with the aid of tape means 12, the terminal board 10 being provided with a plurality of eyelet type terminals 9. But, it has drawbacks in that the eyelet pieces are easily loosened, that the terminal board is often broken and that connection between the antenna coil 11 and the terminal board 10 or between the terminal board 10 and the printed board is unsatisfactorily tight.

Hitherto the antenna coil with terminal board as illustrated in FIG. 4 has been put in use in order to simplify mounting of the antenna coil on a printed board. In the drawing the reference numeral 13 denotes an antenna coil, and the reference numeral 14 denotes a terminal board. The hitherto known antenna coil with terminal board as illustrated in FIG. 4 is constructed such that the antenna coil supporting members 15 and the printed board engagement latch 16 are molded integral with the terminal board 14, the antenna coil 13 is inserted through the antenna supporting members 15 and the lead wires 17 are connected to the terminals 18 by dip soldering. The antenna coil with terminal board as illustrated in FIG. 4 is fastened to the printed board shown in FIG. 5. Namely, the engagement latch 16 is inserted in the engagement hole 20 which is defined in the printed board 19. Thus the antenna coil with terminal board is fastened to the printed board without any danger of being loosened.

Generally it is required that the antenna coil with terminal plate have sufficient heat resistibility to withstand about 350° C., the temperature at which the antenna coil is subjected to dip-soldering in a soldering bath. Further it is required that the antenna supporting members 15 have some flexibility for damping shock, because the ferrite core for the antenna coil 13 tends to be easily broken by shock. Normally most thermoplastic resins have flexibility but are very weak against heat, while thermosetting plastics, such as phenol resin, have a high heat resistance but are too hard or fragile. Very few plastic materials reinforced with glass fiber or the like have both high heat-resistibility and flexibility. Teflon resin is preferably used for the purpose but this material is very expensive.

Since plastic materials have such properties as mentioned above, prior to carrying out the soldering operation for connecting the coil lead wire to the terminal, some tool or the like should be arranged for the conventional antenna coil with terminal board, by which the engagement latch 16 is held remote from the heat source. In the case of certain plastic materials it has been found that the engagement latch 16 tends to tear off.

Further it is pointed out as another drawback with the hitherto known antenna coil with terminal board that, if an antenna rod longer than the terminal board is mounted on the antenna coil with terminal board, the antenna rod is often broken in the event of dropping or the like because the long part of the antenna rod is held unsupported by the terminal board.

OBJECTS OF THE INVENTION

An object of the present invention is to provide a new and useful antenna coil support means which is simple in structure and readily adaptable to a variety of operating conditions and is, moreover, advantageously applicable in view of presently available molding die.

Other objects of the present invention are to provide a new and useful antenna coil in which the physical, chemical, thermal and economical drawbacks inherrent to the conventional as mentioned above ones are completely eliminated.

Another object of the present invention is to provide a new and useful antenna coil in which there is little danger of breakage of the ferrite core mounted thereon.

SUMMARY OF THE INVENTION

The above mentioned objects have been accomplished in accordance with the present invention by the arrangement of mountings at the end portions of the terminal board. In each mounting an opening extends in the vertical direction and an antenna supporting member is fit and fastened in the opening. The terminal board is made of heat resisting material. It is preferable that at the lower end of the insert or connector portion of the antenna supporting member there be provided an engagement latch means in order to facilitate fastening to the mounting. Further it is preferable that a coil bobbin be molded integral with the antenna supporting portion of at least one of the antenna supporting members.

The above and further objects and novel features of the invention will be more fully apparent from the following detailed description when the same is read in connection with the accompanying drawings. It is to be expressly understood, however, that the drawings are for the purpose of illustration only and are not intended as a definition of the limits of the invention.

BRIEF DESCRIPTION OF THE DRAWINGS

The present invention will be now described in detail with reference to the accompanying drawings, in which.

DETAILED DESCRIPTION OF THE INVENTION

Figure 6:
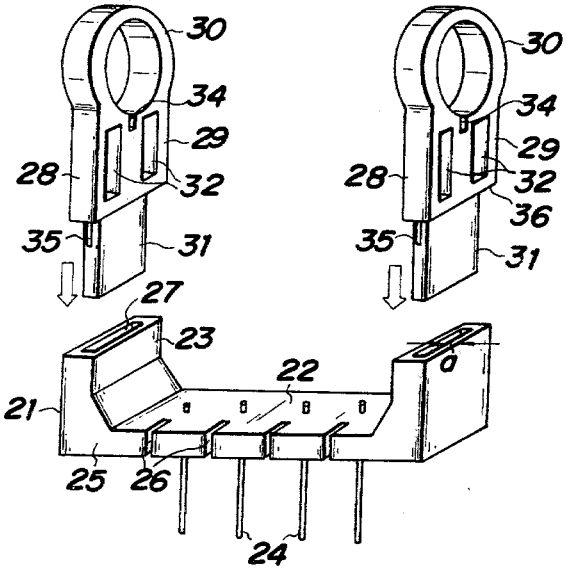
FIG. 6 is an exploded, perspective view of an antenna coil support in accordance with an embodyment of the present invention.
Figure 7:
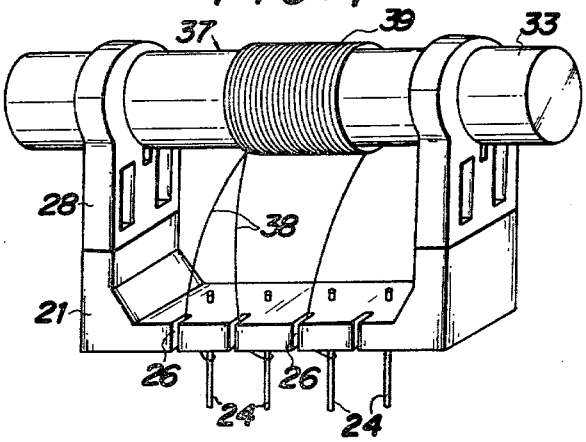
FIG. 7 is a perspective view of an antenna coil and its support assembled together in accordance with the present invention.

FIG. 6 shows an antenna coil support means in accordance with the present invention in the disassembled state, while FIG. 7 shows the same antenna coil and its support assembled together.

In the drawings the reference numeral 21 denotes a terminal board made of heat resisting plastic. The terminal board 21 substantially consists of a main portion 22 of a flat plate and a pair of mountings 23 which are located at respective ends of the elongated main portion 22. The main portion 22 is provided with the required number of terminals 24 which are tightly fastened thereto. A plurality of slits 26 are formed on one side 25 of the main portion 22. The pair of mountings 23 are molded integral with the main portion 22 and each has an opening 27, which extends the full height of the mounting 23. The openings may be formed in any shape such as a circle, rectangle etc. It is to be noted that the reference character a denotes the wall thickness of the mounting 23.

Further, the reference numeral 28 denotes a pair of antenna supporting members which are securely mounted on the terminal board 21. The antenna supporting members 28 are made of resilient plastic material having some resiliency, which does not need particular heat resisting characteristics. The antenna supporting members 28 are each provided with a supporting portion 30 above the resilient portion 29, in which an antenna is to be carried, and an insert or connector portion 31 extending downward to be fit into the opening 27 of a respective mounting 23. To insure the required resiliency of the resilient portion 29 there are formed elongated cutouts 32, the width and length being determined in accordance with the resiliency of the material used. The elongated cutouts 32 serve also for reducing shrinkage of the plastic material, which is caused after completion of molding of the antenna supporting member 28. The supporting portion 30 is formed as a ring through which a rod of a ferrite core 33 is inserted and fastened thereto. In order that the ferrite core 33 be tightly fastened in the supporting portions 30, the supporting portions are plated to a predetermined film thickness and/or provided with a notch 34 on the inner surface thereof. The insert or connector portion 31 is molded as a rectangular column, the cross section of which corresponding to that of the opening 27 of the mounting 23, and it is tightly secured in the opening 27 because the outer dimension of the connector portion is made a little larger than the inner dimension of the opening. Another manner is to provide an elongated protrusion 35 on the side face of the insert or connector portion. It is to be noted that in the illustration in FIG. 6 there are provided two mountings 23, but the number of mountings 23 need not necessarily be limited only to two.

During operation of the antenna coil support constructed in accordance with the present invention, as mentioned above, the antenna supporting members 28 are held on the mountings 23 in such a manner that the shoulder 36 of each mounting comes in abuttment with the upper face of a respective mounting 23. Then an antenna coil 37 is inserted through the openings of the supporting portions 30 so that the antenna coil is securely mounted on the antenna support. In the meantime the lead wires 38 of the antenna coil 37 are connected to the terminals 24 through the slits 26.

When the antenna coil is assembled with the terminal board with the aid of the antenna coil supports in accordance with the present invention, the terminal board 21 and antenna supporting members 28 may be previously assembled prior to placing the antenna coil, but it is preferable that the ferrite core 33 be inserted through the antenna supporting member 28 at the same time as it is inserted through the coil 39, but just before connecting the lead wires to the terminals 24, because this prevents any possibility that the antenna coil may be damaged by the terminal 24 or the terminal 24 being deformed or bent during assembling operation.

Owing to the antenna coil support in accordance with the present invention, the antenna coil 37 can be satisfactorily fastened onto the antenna supporting members 28 and terminal board 21 and subsequently the terminal board 24 can be tightly mounted on the printed board. Further, owing to the fact that the terminal board 21 is made of heat resisting material and the antenna supporting members 28 are of plastic material having high resiliency, there is provided an antenna coil support with high shock absorbability, by means of which the soldering operation can be easily and conveniently conducted. It is to be pointed out as another advantageous feature of the invention that it is possible to some extent without renewal or modification of the existing molding die to adjust the height from the bottom of the terminal board 21 to the antenna coil 37 by arranging a spacer means, such as washer or the like, beneath the shoulder 36, and that in order to change substantially the height, all that is to be done is to manufacture another new molding die for the antenna supporting members 28, which means that modification can be accomplished at low cost. Moreoever in case the diameter and shape of the ferrite core 33 are to be changed, it is required only to modify the molding die for the antenna supporting members 28 at low cost.

Figure 8:
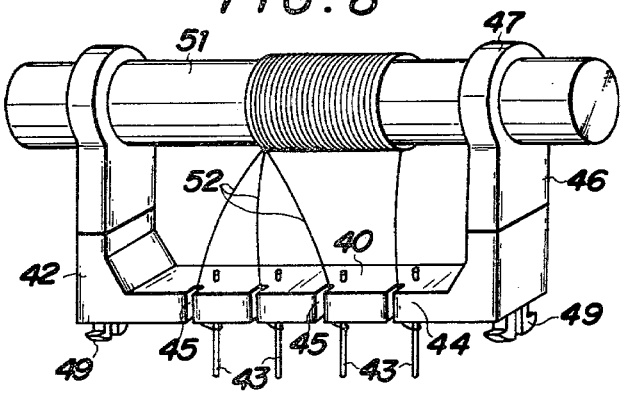
FIG. 8 is a perspective view of an antenna coil with a terminal board in accordance with the present invention.
Figure 10:
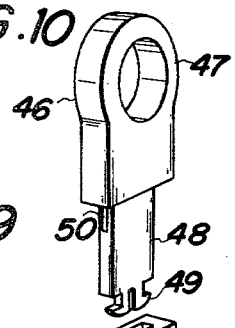
FIG. 10 is a perspective view of antenna supporting members.
Figure 9:
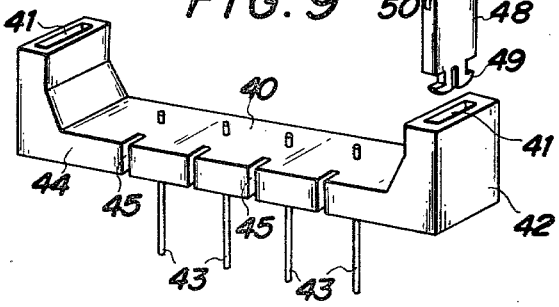
FIG. 9 is a perspective view of a terminal board.

FIG. 8 shows an antenna coil with terminal board in accordance with another embodiment of the present invention. In the drawing the reference numeral 40 denotes a terminal board made of heat resisting plastic material, the terminal board 40 being provided with a plurality of mountings 42, as illustrated in FIG. 9, through which an opening extends in the vertical direction, the mounting 42 being molded integral with the terminal board 40. Further terminal board 40 is provided with a number of terminals 43 which are tightly fastened thereto, there being formed a series of slits 45 on one side of the terminal board 40. In the drawing the reference numeral 46 denotes antenna supporting members which are molded of a plastic material having high shock absorbability and an appropriate flexibility or resiliency. It should be noted that the antenna supporting members 46 are not necessarily made of heat resisting plastic material. As illustrated in FIG. 10, each antenna supporting member 46 comprizes an annular antenna supporting portion 47 at its upper part and an insert or connector portion 48 at its lower part, which is adapted to be inserted into the opening 41 of the mounting 42. Further the insert or connector portion 48 is provided with an engagement latch 49 at the lower part thereof, which serves to prevent this portion 48 from being loosened and pulled out of the opening 41. In FIG. 10 the reference numeral 50 denotes an elongated protrusion located at the upper part of the insert or connector portion 48.

Figure 1:
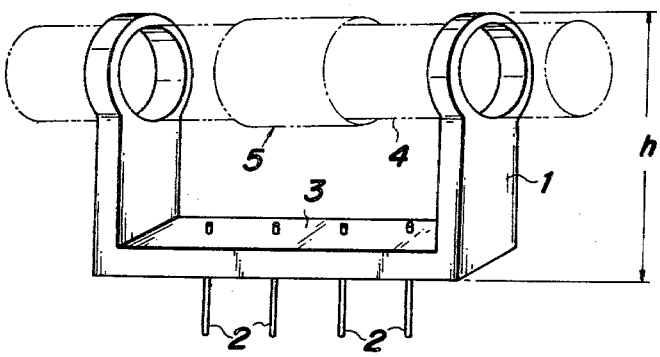
FIG. 1 PRIOR ART
FIGS. 1 to 4 are perspective views of antenna coils and their supports, which are constructed according to the hitherto known methods.
Figure 2:
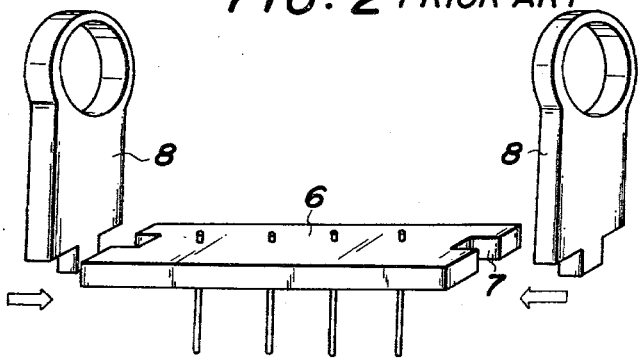
FIG. 2 PRIOR ART
Figure 3:
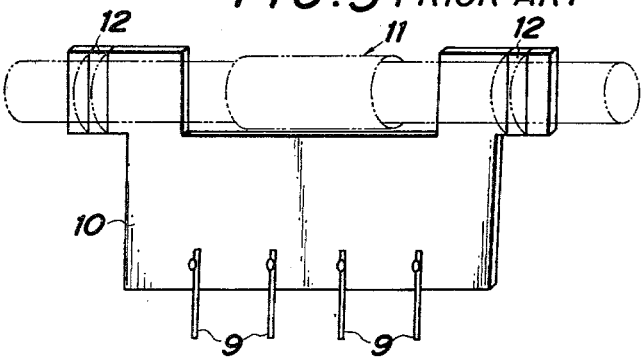
FIG. 3 PRIOR ART
Figure 4:
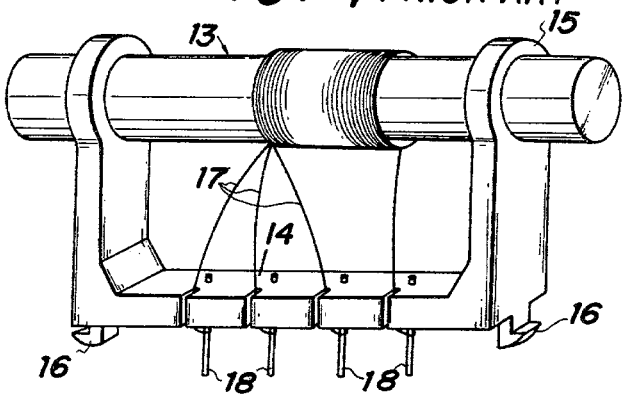
FIG. 4 PRIOR ART
Figure 5:
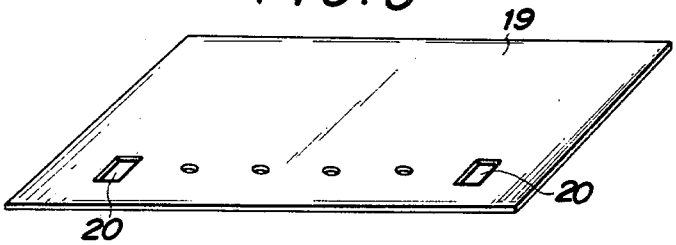
FIG. 5 is a perspective view of a printed board.

Thus an antenna coil with terminal board is constructed in such a manner that the insert or connector portion 48 of each antenna supporting member 46 is inserted into the opening 41 of the respective mounting 42 which is molded integral with the terminal board 40, while the antenna coil 51 is inserted through the openings of the antenna supporting members. The lead wires 52 are connected to the terminals 43 through the slits 45 on the termimal plate 40. In operation the whole assembly is mounted on the printed board 19, as illustrated typically in FIG. 5.

Since the antenna coil constructed in accordance with the present invention has the antenna supporting members 46 and the terminal plate 40 which are separate from each other, the lead wire of the antenna coil and the terminal are soldered together when the inserts or connector portions 48 of the antenna supporting members 46 are provisionally inserted halfway in the opening 41 of the respective mounting 42, and then they are fully inserted in the opening 41 after completion of soldering operation. Owing to the arrangement as mentioned above, the engagement latch 49 is without damage due to exposure to heat during the assembling operation, and, moreover, the plastic material for the antenna supporting members 46 may be selected in consideration of the resiliency of the engagement latch 49 irrespective of the terminal plate 40. When a different thickness of printed board has to be used, only the molding die for the antenna supporting members 46 need be modified. In view of the fact that, however, the insert or connector portion 48 of each antenna supporting member 46 can be fully inserted in the respective opening 41 with much force applied thereon, but may be held a little before full inserting when the elongated protrusion comes in engagement with the inlet portion of the opening 41, any little difference in thickness of the printed board can be easily compensated for by adjusting the amount to which the insert or connector portion 48 is inserted into the opening 41. As mentioned above, the antenna support in accordance with the present invention can adapt itself economically to any minor change or modification of the printed board or the other owing to the arrangement of the heat resisting terminal plate and the resilient support means.

Figure 11:
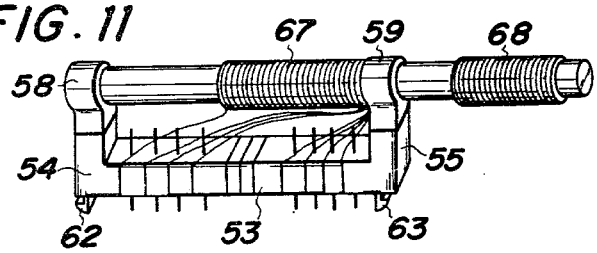
FIGS. 11 to 14 are perspective views of an antenna coil, in accordance with the present invention, being shown in an assembled state as well as in a disassembled state.
Figure 12:
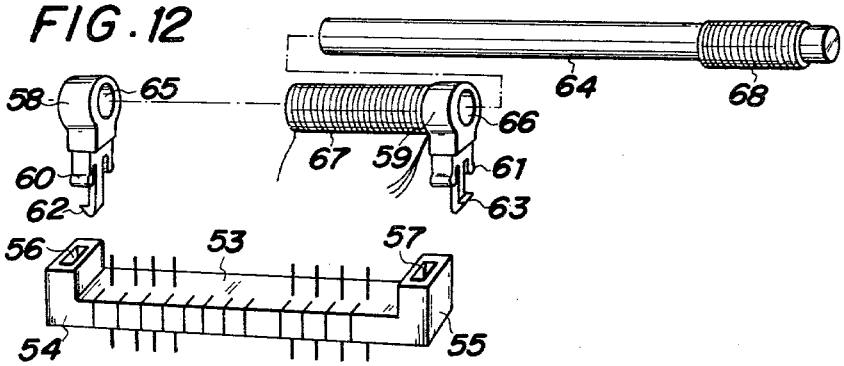
Figure 13:
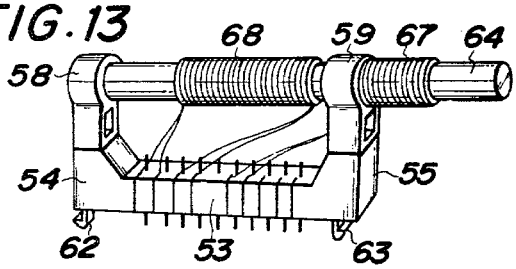
Figure 14:
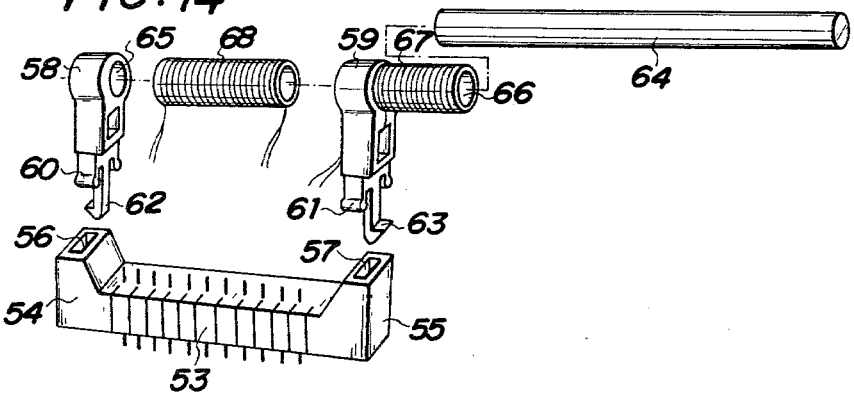

FIGS. 11 and 12 show an antenna coil in accordance with another embodiment of the present invention, while FIGS. 13 and 14 show another antenna coil in accordance with still another embodiment of the present invention. FIGS. 11 and 13 illustrate the antenna coil in the completely assembled state, FIGS. 12 and 14 illustrate how the antenna coil is being assembled.

As illustrated in these drawings, the antenna coil in accordance with the present invention is constructed such that the antenna supporting members 58 and 59 are fit in and fastened to the openings 56 and 57 of the mountings 54 and 55, respectively, which stand upright from the terminal board 53. The antenna supporting members 58 and 59 are provided at the lower part thereof with engagement means 60 and 61 and engagement latches 62 and 63, respectively, so as to enable them to be tightly fastened to the terminal board and printed board, the engagement means 60 and 61 by their sideway-expansion against the inner wall of the opening hold the supporting member tightly within the respective mounting, and the enagement latches 62 and 63 by expansion and engagement to the printed board hold the assembly against the printed board. As illustrated in the drawings, the antenna supporting members 58 and 59 are molded separately from the terminal board 53 and their material is selected in view of its vibration-resistibility rather than heat-resistibility. Further it is an ordinary practice that there is provided a hollow portion in the antenna supporting member so as to increase its shock-resistibility.

The antenna supporting member 58 has an opening 65 through which the ferrite core 64 is fit and fastened, and the antenna supporting member 59 has an opening 66 through which the ferrite core 64 is fit. And the antenna supporting member 59 is provided with a tubular coil bobbin 67 on which the coil is to be wound, the coil bobbin being molded integral with the antenna supporting member 59. The reference numeral 68 in the drawings denotes another coil bobbin which is located free from both antenna supporting members 58 and 59.

Owing to the fact that the coil bobbin 67 is molded integral with the antenna supporting member 59, which has high vibration-resistibility as well as high shock-resistibility, and the ferrite core 64 is carried in the antenna supporting member 59, breakage trouble with the ferrite core 64, which is caused by dropping, shock or the like, is remarkably reduced.

In the embodiments of the invention as illustrated in FIGS. 11 to 14, the antenna supporting members 58 and 59 are molded separate from the terminal board 53. The present invention, however, should not be limited only to this arrangement as illustrated in these drawings and it may be advantageously applicable even if the antenna supporting members 58 and 59 are molded integral with the terminal plate 53.

What is claimed is:

1. An antenna coil support comprising a terminal board made of heat resisting plastic; a plurality of mountings provided on, and made integral with, said terminal board, each mounting having an axial channel opening on a top end of said mounting; and antenna supporting members made separate from said terminal board and said mountings and made of a resilient material, each supporting member having an upper part comprising an antenna supporting portion and a lower part comprising a connector portion, said connector portion of each supporting member being removably engageable with said channel of a respective mounting, said connecting portion including an engagement means and an engagement latch, said engagement means fitting into said channel and preventing removal therefrom of said connecting portion, and said engagement latch passing through said channel and said terminal board and being interconnected with a printed board to secure said printed board and said antenna coil support together.

2. An antenna coil support comprising a terminal board made of heat resisting plastic; a plurality of mountings provided on, and made integral with, said terminal board, each mounting having an axial channel opening on a top end of said mounting; and antenna supporting members made separate from said terminal board and said mountings and made of a resilient material, each supporting member having an upper part comprising an antenna supporting portion and a lower part comprising a connector portion, said connector portion of each supporting member being removably engageable with said channel of a respective mounting.

3. An antenna coil support according to claim 2, wherein said connector portion of said supporting member includes an engagement latch on a distal end thereof, said engagement latch fitting into said channel and preventing removal therefrom of said connector portion.

4. An antenna coil support means according to claim 2, wherein the supporting portion of at least one of said supporting members includes a coil bobbin extending outwardly from, and made integral with, said supporting portion.

5. An antenna coil support according to claim 2, wherein said supporting members include a resilient portion positioned intermediate said supporting portion and said connecting portion and including elongated cutouts.

6. An antenna coil support according to claim 2, wherein the diameter of said connecting portion of each of said supporting members is slightly greater than the diameter of said channel of said respective mounting.

7. An antenna coil support according to claim 2, wherein said connecting portion of each of said supporting members includes an elongated protrusion on a surface thereof.

8. An antenna support according to claim 2, wherein said connecting portion of each of said supporting members includes an elongated protrusion on a surface thereof.

9. An antenna coil support according to claim 2, wherein there are two mountings and two support members.

* * * * *